US005249425A

United States Patent [19]

Longsworth

[11] Patent Number: 5,249,425

[45] Date of Patent: Oct. 5, 1993

[54] VENTING CONTROL SYSTEM FOR CRYOSTATS

[75] Inventor: Ralph C. Longsworth, Allentown, Pa.

[73] Assignee: APD Cryogenics Inc., Allentown, Pa.

[21] Appl. No.: 906,401

[22] Filed: Jul. 1, 1992

[51] Int. Cl.[5] ..... F25B 19/02; F25B 9/00; F25B 19/00

[52] U.S. Cl. ..... 62/6; 62/50.7; 62/51.1; 62/51.2; 165/156; 165/10

[58] Field of Search ..... 62/6, 51.1, 51.2, 50.7; 165/10, 155

[56] References Cited

U.S. PATENT DOCUMENTS

| | | | |
|---|---|---|---|
| 2,991,633 | 7/1961 | Simon | 62/51.2 |
| 3,018,643 | 1/1962 | Evers | 62/51.2 X |
| 3,188,824 | 6/1965 | Geist et al. | 62/51.2 X |
| 3,942,010 | 3/1976 | Peterson et al. | 62/51.2 X |
| 4,002,039 | 1/1977 | Cramer et al. | 62/51.2 X |
| 4,671,080 | 6/1987 | Gross | 62/51.2 X |
| 4,781,033 | 11/1988 | Steyert et al. | 62/51.2 |
| 4,825,667 | 5/1989 | Benedict et al. | 165/156 X |
| 4,873,831 | 10/1989 | Dehne | 62/51.2 X |
| 5,003,783 | 4/1991 | Reale | 62/51.2 |
| 5,012,650 | 5/1991 | Longsworth | 62/6 X |

FOREIGN PATENT DOCUMENTS

| | | | |
|---|---|---|---|
| 1657899 | 6/1991 | U.S.S.R. | 62/50.7 |

*Primary Examiner*—Henry A. Bennet
*Assistant Examiner*—Christopher B. Kilner
*Attorney, Agent, or Firm*—Helfgott & Karas

[57] ABSTRACT

A cryostat in which a venting conduit is connected to a reservoir of the cryostat but no venting of cryogen within the reservoir can occur while fluid is flowing under pressure within the heat exchanger of the cryostat.

7 Claims, 1 Drawing Sheet

VENTING CONTROL SYSTEM FOR CRYOSTATS

This invention relates to the field of cryostats, and more particularly to cryostats which utilize an inventory of liquid cryogen derived from a heat exchanger to maintain a temperature sensing element at cryogenic temperatures by evaporation or sublimation of the cryogen after the fluid flow through the heat exchanger is stopped.

BACKGROUND OF THE INVENTION

Such cryostats are used, for example, in infrared detectors and missile guidance systems which operate under cryogenic conditions. Typically, the cryostat includes a cryogenic cooler, such as a Joule Thomson heat exchanger, which is connected to a reservoir within which an inventory of liquid cryogen is collected that is derived from the initially cooled gas/liquid discharge of the heat exchanger. The temperature sensing element of the IR detector or guidance system is mounted in heat conducting relation with the reservoir. After the liquid cryogen is collected, the fluid flow through the heat exchanger is stopped and the collected cryogen is vented to a vacuum or other source of reduced pressure so that further heat is transferred from the temperature sensing element to the cryogen as the cryogen evaporates or sublimes, even to the point where the cryogen freezes and cools the temperature sensing element below the triple point of the cryogen, e.g., 63 degrees Kelvin for Nitrogen.

One such cryostat is shown in my U.S. Pat. No. 5,012,650 in the form of a Joule Thomson heat exchanger directly connected to a cryogen reservoir containing a composite matrix material particularly useful in retaining an inventory of liquid cryogen in the reservoir derived from the gas/liquid discharge of the heat exchanger as well as in retaining a significant amount of the liquid/solid cryogen when it is subsequently cooled by reducing its pressure. In an improvement of this cryostat, which has been described and claimed in my U.S. patent application entitled "Method & Apparatus for Collecting Liquid Cryogen", filed concurrently herewith, the gas/liquid discharge from the heat exchanger is directed to flow through this matrix material within the reservoir in order to fill the reservoir more rapidly.

An important feature of the cryostat shown in this U.S. Pat. No. 5,012,650 is that the reservoir is also directly connected to a venting conduit in the form of a large diameter vent tube through which the gas from the reservoir can vent to the vacuum. Preferably, this vent tube also forms the core of the heat exchanger. Without this venting conduit, the cryogen within the reservoir would be forced to vent through the high impedance of the heat exchanger itself. Since the temperature at which a cryogen evaporates or sublimes is a function of its pressure, the very low impedance of the large diameter venting tube allows the cryogen more rapidly to achieve lower pressures and to reach lower temperatures.

However, during the initial period that the gas is flowing through the heat exchanger and into the reservoir, it is imperative that no flow of this gas out of the reservoir though this venting conduit occurs. Any such venting flow will by-pass the effect of the heat exchanger and reduce its cooling power during this reservoir filling stage. This is especially true if the reservoir venting conduit also forms the core of the heat exchanger. It is also imperative that the venting conduit be fully opened shortly after the fluid flow within the heat exchanger is stopped. Any significant delay will allow the liquid cryogen in the reservoir to rapidly warm up, and any partial opening will inhibit the evaporation and sublimation of the cryogen, thereby reducing the rapidity and effectiveness of the cool-down.

SUMMARY OF THE INVENTION

Accordingly, a general object of the invention is to provide a cryostat in which a venting conduit is connected to a reservoir of the cryostat, but no venting of cryogen within the reservoir can occur while fluid is flowing under pressure within the heat exchanger of the cryostat.

A more specific object of the invention is to provide a cryostat of the type in which a reservoir is directly connected to receive and retain liquid cryogen derived from the gas/liquid discharge of a Joule-Thomson heat exchanger, and wherein self-actuating valve means are also provided for preventing venting of gas from the reservoir to a vacuum through a venting conduit as long as fluid is flowing in the heat exchanger but which will cause such venting to occur shortly after such fluid flow through the heat exchanger is stopped.

A further object is to provide such self-activating venting control means where the venting conduit also forms the core of the Joule-Thomson heat exchanger.

In general, in accord with the invention, a reservoir is directly connected to retain liquid cryogen derived from the gas/liquid discharge of a heat exchanger, and a venting conduit is connected to the reservoir to permit direct venting of the reservoir to a vacuum or reduced pressure source after the gas flow to the heat exchanger is stopped. A self-activating valve means is connected to be responsive to the pressure of gas flow in the heat exchanger in order to block the venting through the venting conduit as long as the gas flow continues in the heat exchanger. Such venting control means also contains means for fully unblocking the venting conduit whenever gas flow in the heat exchanger is shut off.

In a preferred embodiment of the invention, the venting conduit comprises a large diameter core of a Joule-Thomson heat exchanger, and the self-activating valve means comprises a gas actuated spring-biased valve located at the "warm" end portion of the venting conduit remote from the reservoir.

DETAILED DESCRIPTION OF THE INVENTION

The novel features believed characteristic of the invention are set forth in the accompanying claims. The invention itself, together with further objects and advantages thereof is set forth in the following description in which:

Figures 1, 2:
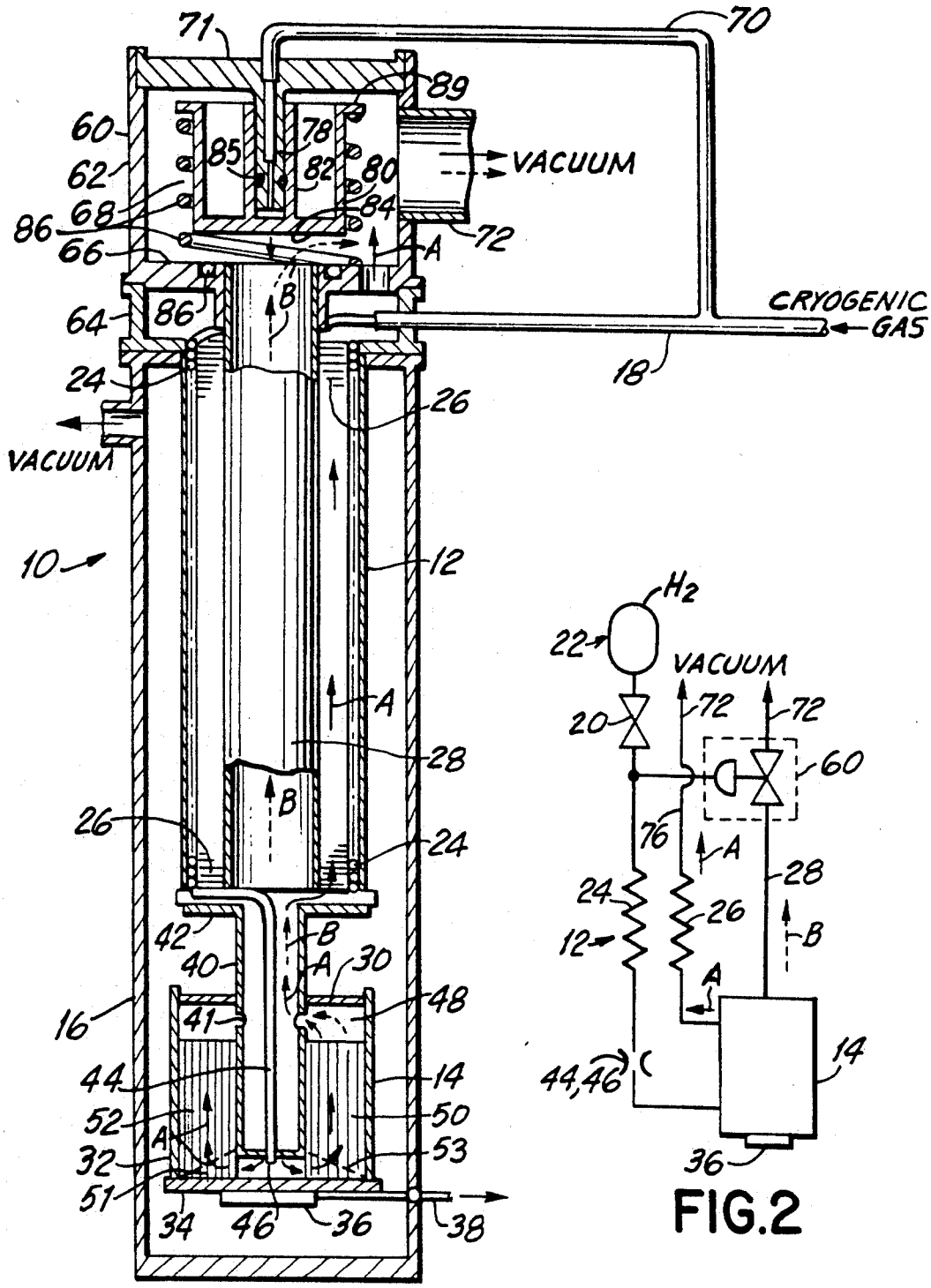
FIG. 1 is a cross sectional view of a cryostat embodying the invention.
FIG. 2 is a process schematic of the operation of a cryostat embodying the invention.

Referring to the drawing, there is shown a cryostat 10 comprising a heat exchanger 12, shown as a Joule Thomson heat exchanger, and a cryogen storage reservoir 14 directly connected to receive and retain liquid cryogen derived from the gas/liquid discharge of the heat exchanger 12. Both heat exchanger 12 and reservoir 14 are encased within a evacuated enclosure 16, and the heat exchanger 12 is connected to a source, shown as bottle 22, of cryogen gas, such as nitrogen or argon under pressure, through a gas inlet tube 18 and a start/stop valve 20 (see FIG. 2). Heat exchanger 12 is shown as the matrix tube type, such as described in my U.S. Pat. No. 4,781,033, wherein the cooling finned tube 24 is encased in a matrix 26 of fine wire mesh and is wound around a central venting conduit 28 comprising a large diameter, axially extending mandrel which also forms the core of the heat exchanger 12.

Reservoir 14 comprises an annular top wall 30, a cylindrical side wall 32, and a circular bottom wall 34 to which is attached the object to be cooled, shown as a temperature sensor 36 which may be an IR detector. Electrical wires 38 are connected to temperature sensor 36 and extend out through the evacuated enclosure 16 to enable temperature measurement.

The entire reservoir 14 is suspended from the heat exchanger 12 by means of an elongated central tube 40 which is attached to an annular bottom plate 42 of the heat exchanger 12. Tube 40 passes axially through the center of the annular top wall 30 of the reservoir 14. Central tube 40 extends within reservoir 14 to a plane closely spaced from the center of the bottom wall 34 in the region of the temperature sensor 36. The restricted outlet tube 44 of heat exchanger 12 also extends axially within this reservoir supporting tube 40 and passes through an end plate 43 to terminate in a discharge orifice 46 which is also closely spaced from the bottom wall 34 of reservoir 14 immediately above the temperature sensor 36. The space between this central supporting tube 40 and the outer cylindrical wall 32 of reservoir 14 is filled, except for a small annular space 48 adjacent the top cover 30, with a combined thermally conducting and cryogen liquid retaining matrix 50. Tube 40 also has a plurality of circumferentially spaced holes 41 formed therein in the region of annular space 48 to permit passage of gas between space 48 and the interior of tube 40.

Matrix 50 may conveniently comprise tightly rolled alternate layers of copper wire mesh and glass fibers as described and claimed in my aforementioned U.S. Pat. No. 5,012,650. The layers of thermally conductive wire mesh extend in contact with the bottom wall 34, but the layers of liquid absorbent glass fibers are preferably spaced from the bottom wall 34 along a conical path indicated by dashed line 52 from the end of tube 40 down to the intersection of the side and bottom walls 32, 34 of reservoir 14. This conical space allows the gas/liquid discharge from orifice 46 to flow through the porous wire mesh and up through the combined layers of wire mesh and glass fibers of matrix 50, as indicated by arrows A. This preferable construction, whereby the gas/liquid discharge flows beneath and through the matrix 50 in order to enhance the retention of liquid cryogen in reservoir 14, is more fully described in my pending patent application entitled "Method and Apparatus for Collecting Liquid Cryogen", filed concurrently herewith.

In accord with the invention, a self-activated valve means 60 is provided for controlling the venting of reservoir 14 to a vacuum or other source of reduced pressure in response to the flow of cryogen gas in the heat exchanger 12. Valve means 60 comprises a vacuum tight housing 62 which is attached to the top "warm" end of the heat exchanger 12 by means of a collar 64 between the envacuated enclosure 16 of the heat exchanger and the bottom wall 66 of housing 62. This bottom wall 66 surrounds and connects to the top end portion of venting conduit 28 and also forms the seat of the gas actuated venting valve 68 within the valve means 60. Valve means 60 is also connected through a gas inlet tube 70, extending between the center of the circular top wall 71 of housing 62 and the cryogen gas inlet tube 18, in order to receive and be activated by the same gas pressure as that delivered to the heat exchanger 12. A large diameter outlet tube 72 for venting to a vacuum is connected to the cylindrical side wall 74 of valve housing 62. The bottom wall 66 of housing 62 also has an opening 76 formed therein adjacent to outlet tubed 72 to permit passage of cryogen gas returning from reservoir 14 back through the matrix 26 and out of heat exchanger 12 to the outlet tube 72.

The venting valve 68 is of the pneumatically actuated type which closes when gas under pressure is supplied thereto, and which opens when the input gas pressure drops below a preset threshold value. Valve 68 has a fixed piston 78 which depends from the center of housing cover 72 and which receives the actuating gas from input tube 70. A cup-shaped movable valve body 80 has a central drive cylinder 82 which snugly surrounds and rides on piston 78, and which drives the valve body 80 downward so that its bottom wall 84 completely covers and blocks the top opening of the venting conduit 28 when input gas pressure is supplied to piston 78. An O-ring 85 is preferably included around the surface of the fixed piston 78 to maintain the driving gas pressure as the cylinder 82 is moved, and an O-ring 87 is preferably also included in the top surface of the bottom housing wall 66 to insure such closure of the venting conduit 28. A helical spring 86 surrounds movable valve body 80 and extends between an outward top flange 89 of the valve body 80 and the bottom wall 66 of the valve housing to normally bias and maintain the valve body in its open position, as well as to return the valve body 80 to such open position, as shown in the drawing, wherein the bottom wall 66 of valve body 80 is spaced from the open top end of the venting conduit 28 whenever no imput gas pressure is supplied to piston 78.

Thus, in the operation of the embodiment of the invention shown in FIG. 1 and schematically illustrated in FIG. 2, a cryogenic gas, such as Argon or Nitrogen under suitable high pressure, is supplied from gas bottle 22 through a manually operated start/stop valve 20 to both input tubes 18 and 70. The gas pressure immediately causes the valve body 80 to be driven downward by piston 78 and cylinder 82, against the biasing force of spring 86, to cover and block the top opening of venting conduit 28 and to completely shut off any venting of gas therethrough from the reservoir 14. The cryogen gas simultaneously flows under pressure through the helical finned tube 24, the outlet tube 44 and the discharge orifice 46 of the heat exchanger 12 to produce a gas/liquid discharge which, as indicated by the solid arrows A, passes through matrix 50 and holes 41 of central tube 40 within reservoir 14, and then returns through the impedance of matrix 26 of heat exchanger 12 and out to the vacuum through aperture 76 and outlet tube 72 in order to cool the cryogen gas and begin to fill the reservoir with liquid cryogen.

This cryogen circulation within the heat exchanger and reservoir continues under gradually decreasing pressure until a sufficient inventory of liquid cryogen is obtained in reservoir 14. The flow of cryogen gas is then stopped by manually operating the start/stop valve 20. This causes the gas pressure within the heat exchanger 12 and input gas tubes 18 and 70 to drop rapidly until the force of spring 86 overcomes the force of the input gas pressure within piston 78 and returns the valve body 80 to its normal elevated open position. As indicated by the dashed arrows B, the accumulated liquid cryogen within reservoir 14 is thereupon vented through the large diameter venting conduit 28 and equally large diameter outlet tube 72 to a vacuum or other source of reduced pressure, thereby to further cool the liquid cryogen in the reservoir, along with the temperature sensing element 36 in heat conductive relation thereto, down to cryogenic temperatures. It will be appreciated that throughout the initial cooling cycle during which the gas is flowing in the heat exchanger, and even while the gas pressure is being rapidly reduced because further gas flow has stopped, the heat exchanger is continuing to cool the gas/liquid discharge passing through the reservoir 14. Throughout this period, the venting conduit 28 is closed, and there is no gas flow therethrough to by-pass or reduce the cooling effect of the heat exchanger. However, just as soon as the gas pressure in the heat exchanger reduces below a preset threshold value, the cryogen liquid collected in the reservoir is immediately and automatically directly vented to the vacuum in order to produce the further fast cool down of the cryostat.

In a test of a cryostat incorporating the self-activating valve means described in the FIG. 1 embodiment of the invention, the area of piston 78 was sized and the biasing force of spring 86 was adjusted to elevate the valve body member 80 when the input gas pressure drops below a threshold pressure of 1 MPa. The gas bottle 22 was filled with Nitrogen charged to a pressure of 40 MPa (6000 psi) and allowed to flow until the pressure dropped to about 15 MPa (2200 psi). by which time a considerable inventory of liquid nitrogen had been collected in reservoir 14. The gas flow to the heat exchanger was then stopped by closing start/stop valve 20, but the valve means 60 remained activated with venting conduit 28 blocked, until the input gas pressure dropped below the 1 MPa threshold value, thereby allowing most of the residual gas within the heat exchanger to bleed out. As soon as the pressure dropped below this threshold value, the valve body was elevated by spring 86 to permit direct venting of the liquid cryogen within the reservoir. This sequence of events occurred quite rapidly, and temperatures of about 50 degrees Kelvin were attained at the temperature sensing element 36 within about 15 seconds of the stopping of the gas flow.

It will be appreciated that although I have described the invention in connection with a specific embodiment, several modifications may be made. For example, the self-activated valve means may be incorporated in multi-stage heat exchangers which have gas supplied from two or more bottles. The gas that is used to actuate the valve is the one that flows throughout the time that the heat exchanger is providing the cooling. Typically, this would be the gas that is flowing in the first warmest stage. It is to be understood that all such modifications which fall within the scope and spirit of the appended claims are also intended to be covered thereby.

What is claimed is:

1. In combination, a heat exchanger having means for receiving a cryogen gas under pressure, a reservoir connected to receive and store liquid cryogen received from a gas/liquid discharge of said heat exchanger, a conduit connected to said reservoir for providing a direct venting path from said reservoir to a source of reduced gas pressure, and a self-activating valve means for blocking the venting of said reservoir through said conduit in response to the pressure of gas received by said heat exchanger.

2. The combination of claim 1, wherein said heat exchanger is a Joule-Thomson heat exchanger having a central core, and said venting conduit comprises said central core of said heat exchanger.

3. The combination of claim 1 wherein said valve means also includes means for unblocking said venting conduit in response to a reduction in said gas pressure below a preset threshold value.

4. The combination of claim 2, wherein said gas receiving means of said heat exchanger has a gas input tube at one end of said heat exchanger for connection to a source of high pressure cryogen gas and said reservoir is connected to an opposite end of said heat exchanger, said valve means being located to block said venting conduit at said one end of said heat exchanger.

5. The combination of claim 3, wherein said self-activating valve means comprises a valve body and a spring biasing said valve body in its conduit unblocking position in the absence of gas pressure.

6. The combination of claim 4, wherein said valve means has a gas input tube in fluid communication with the gas input tube of said heat exchanger.

7. The combination of claim 5, wherein said heat exchanger is a Joule-Thomson heat exchanger having a central core and a matrix encased cooling tube surrounding said core and said venting conduit forms said core of said heat exchanger.

* * * * *